US005553958A

United States Patent [19]

Bedol

[11] Patent Number: 5,553,958

[45] Date of Patent: Sep. 10, 1996

[54] COMBINATION BOOK AND HOLEPUNCH ASSEMBLY

[76] Inventor: Mark A. Bedol, P.O. Box 2847, Rancho Cucamonga, Calif. 91729

[21] Appl. No.: 357,729

[22] Filed: Dec. 16, 1994

Related U.S. Application Data

[63] Continuation-in-part of Ser. No. 241,012, May 11, 1994, Pat. No. 5,409,319.

[51] Int. Cl.[6] ..... B42F 3/00

[52] U.S. Cl. ..... 402/1; 402/4

[58] Field of Search ..... 402/1, 4; 85/145, 85/167, 620

[56] References Cited

U.S. PATENT DOCUMENTS

| | | | |
|---|---|---|---|
| 1,285,048 | 11/1918 | Cooke, Jr. | 402/1 |
| 1,336,998 | 4/1920 | Bottle | 402/1 |
| 2,445,440 | 7/1948 | Klemm | 402/1 X |
| 5,058,736 | 10/1991 | Bedol | 206/214 |
| 5,209,592 | 5/1993 | Bedol | 402/1 |
| 5,340,229 | 8/1994 | Schwartzman | 402/1 X |

OTHER PUBLICATIONS

McGill, Inc., 2–piece, 3–hole binder punch, (2 photographs).

McGill, Inc., plastic base/metal hinge, 3–hole punch (2 photographs).

Day Runner, Inc. Pro™ holepunch. (2 photographs).

Day Runner, Inc. No. 043–112, 6–hole holepunch (2 photographs).

*Primary Examiner*—Willmon Fridie, Jr.

[57] ABSTRACT

A combination book and holepunch assembly includes a book having a flat portion thereon and a holepunch assembly securely attached to the flat portion. The holepunch assembly comprises a housing comprising a first rigid substantially flat plate securely connected to the flat portion. The housing has a set of a plurality of spaced holes formed therethrough a side thereof. The housing further includes an opening in a central portion thereof. A plurality of spaced hinges are located on a side edge of the central portion defined by the opening. A second rigid plate is included having a first hingedly connected via the spaced hinges to the first rigid plate. The second plate has a shape complementary to the shape of the central opening so that when the second rigid plate is in a stowed position it may be supported with the central opening. The second plate includes spaced projections formed on an upper surface thereof. The projections are so sized and spaced to align with the second set of spaced holes in the first plate when the second plate is rotated away from the stowed position so as to provide a hole punching capability when paper is inserted between the first plate and the second plate.

16 Claims, 1 Drawing Sheet

10
12
16
14
22
46
15
20
54
2A
2B
50
28
26
24
44

16
22

62
60
64
72
66
68
7
66
66
70

62
64
60
70
60
62
70
64

16
28
26
16
10
12
30

10
h
16
26
36
16
12

32
34
31
16
26
36
16
10

28
26

COMBINATION BOOK AND HOLEPUNCH ASSEMBLY

This is a continuation-in-part of application Ser. No. 08/241,012 filed May 11, 1994, now U.S. Pat. No. 5,409,319.

BACKGROUND OF THE INVENTION

1. Field of the Invention

The present invention relates to books and more particularly to a book with an integral holepunch mechanism.

2. Description of the Related Art

Users of notebooks, including businessmen and students, often desire to have various articles such as pencils and pens at their easy disposal when they use their notebook and to be secure from being lost when they carry their notebooks from one location to another.

In partial solution to this problem, present applicant Mark A. Bedol, invented a "Notebook Organizer Including Slidable Element", U.S. Pat. No. 5,050,736. The U.S. Pat. No. '736 patent discloses an organizer comprising a base with holes for engagement with the rings of a ringed notebook. The base includes a plurality of partitions which divide the base into a plurality of compartments. The patent also discloses an electronic calculator having a longitudinal extension thereon being slidably engageable with, and supported between, opposing partition surfaces.

Present applicant Mark A. Bedol, has also invented "Notebook Insert With Calculator and Holepunch", U.S. Pat. No. 5,209,592, which discloses a notebook insert comprising a housing, an electronic calculator attached to the housing and a holepunch assembly also attached to the housing. The housing has a periphery with multiple holes therethrough which are spaced to be adapted for engagement with the rings of a ringed notebook.

McGill, Inc. of Maringo, Ill., discloses a three-hole binder punch which is insertable into the rings of a ringed binder. This binder punch involves two pieces. A first piece inserts through the rings of the binder and a second piece, the holepunch mechanism, snaps into place on the first piece.

McGill also manufactures another three-hole paper punch under the trademark Trident. The Trident holepunch includes a plastic base with a metal hinge mechanism attached along the top surface thereof.

Day Runner, Inc., Fullerton, Calif. distributes a seven-hole punch under the trademark Pro. The Pro holepunch comprises a first plate hinge connected to a second plate, the two cooperating to form a holepunch mechanism which inserts into a ringed binder. The Pro holepunch is in a stowed position when the two plates are in cooperative engagement (i.e., the holepunch is closed). The Pro holepunch does not lie flat within the open position.

Day Runner, Inc. distributes another holepunch, a six-hole punch, Part No. 043-112. The six-hole punch cannot be used to punch paper unless it is removed from the rings of the binder.

Present applicant has also invented another device which is an improved notebook insert with holepunch. The improved device is the parent application to this patent application and bears Ser. No. 08/241,012.

All of the aforementioned devices are actually inserts to notebooks. Although use of such inserts are desirable in certain instances, in other instances it would be more desirable to have the holepunch mechanism integral to a book.

For example, although notebook inserts are convenient to use they do use up valuable space within the rings of a ringed binder. If such space is a priority another holepunching mechanism would be desired. Furthermore, prior art holepunch inserts have generally been limited to use with ringed binders.

OBJECTS AND SUMMARY OF THE INVENTION

It is therefore a principal object of the present invention to incorporate holepunching capability with a book.

Another object is to maximize the usable space in a ringed binder.

Yet another object is to provide a holepunching mechanism which is not limited to applications with ringed binders.

One embodiment of the present invention takes the form of a combination book and holepunch assembly which comprises a book having a flat portion thereon and a holepunch assembly securely attached to the flat portion. The holepunch assembly comprises a housing comprising a first rigid substantially flat plate securely connected to the flat portion. The housing has a set of a plurality of spaced holes formed therethrough. A second rigid plate is included having a first side hingedly connected to the first rigid plate. The second plate includes spaced projections formed on an upper surface thereof. The projections are so sized and spaced to align with the second set of spaced holes in the first plate when the second plate is rotated away from a stowed position so as to provide a hole punching capability when paper is inserted between the first plate and the second plate.

Other objects, advantages, and novel features will become apparent from the following detailed description of the invention when considered in conjunction with the accompanying drawings.

BRIEF DESCRIPTION OF THE DRAWINGS

The same parts or elements throughout the drawings are designated by the same reference characters.

DETAILED DESCRIPTION OF THE PREFERRED EMBODIMENTS

Figures 1, 2A, 2B, 2C, 3, 4, 5, 6, 7:
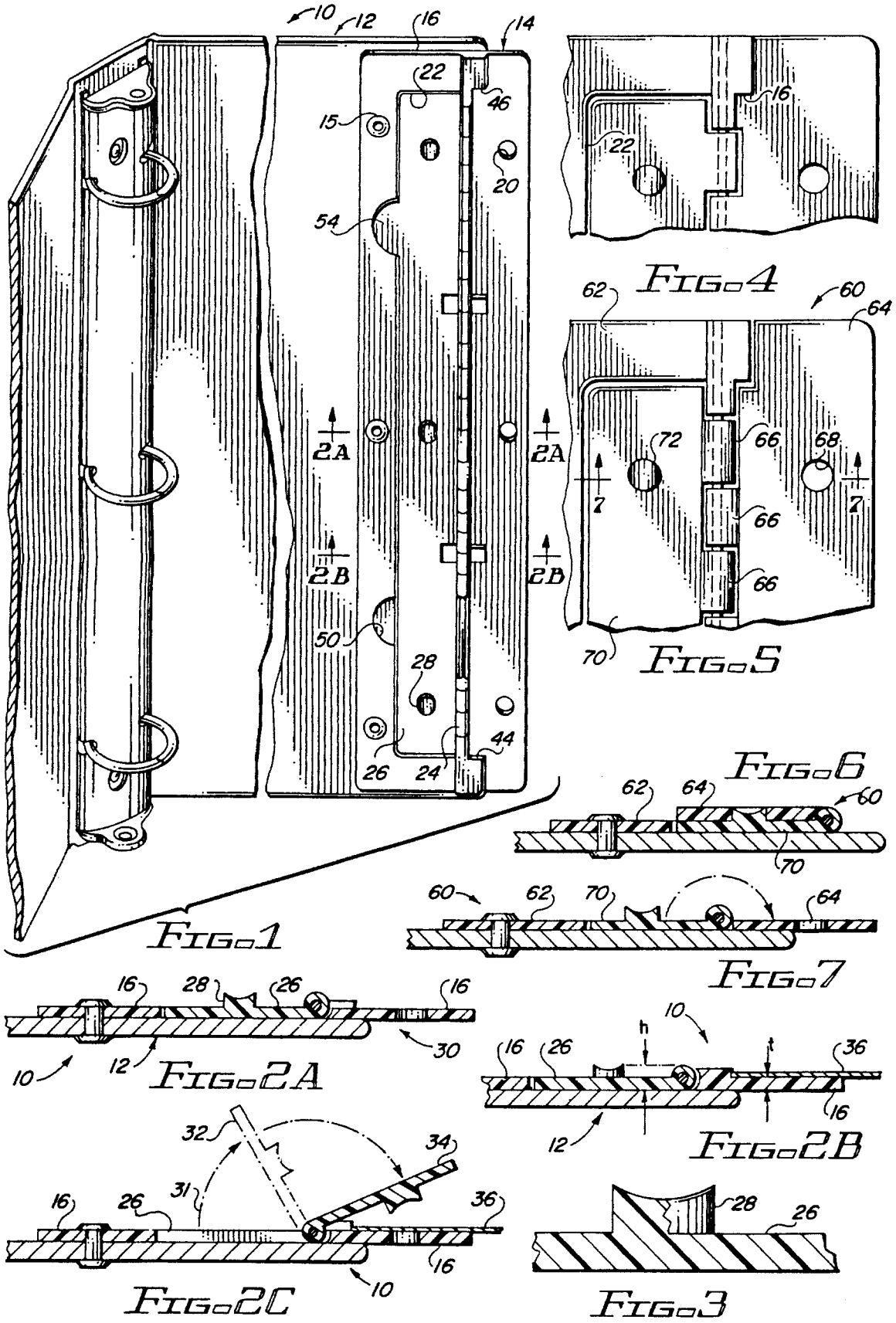
FIG. 1 is a perspective view of the combination book and holepunch assembly of the present invention.
FIG. 2A is a side view of the combination book and holepunch assembly, partially in cross section, taken along line 2A—2A of FIG. 1.
FIG. 2B is a side view of the combination book and holepunch assembly, partially in cross section, taken along line 2B—2B of FIG. 1, shown with paper inserted.
FIG. 2C is a bottom end view of the combination book and holepunch assembly, showing the working motion of the holepunch plate rotating to punch paper.
FIG. 3 is a enlarged detail of the punch of the holepunch assembly.
FIG. 4 is a top view of an upper portion of the combination book and holepunch assembly of FIG. 1.
FIG. 5 is a top view of an upper portion of a second embodiment of the combination book and holepunch assembly, in which a portion of the assembly may be stowed when not in use.
FIG. 6 is a side view of a second embodiment of the combination book and holepunch assembly, partially in cross section, shown in a stowed position.
FIG. 7 is a side view of the notebook insert, partially in cross section, taken along line 7—7 of FIG. 4, shown in an open position to receive paper.

Referring now to the drawings and the characters of reference marked thereon FIG. 1 illustrates a first embodiment of the combination book and holepunch assembly of the present invention, designated generally as 10. The apparatus 10 includes a book, designated generally as 12, having a flat portion thereon, such as a front or back cover. A holepunch assembly designated generally as 14, is securely attached to the flat portion, such as by rivets 15.

Although the principles of the present invention are particularly adaptable to a 3-ring or other ringed notebook, it is understood that such a usage is shown for the purpose of illustration and not limitation. Other types of books may use the principles described hereinafter.

Holepunch assembly 14 includes a housing 16 which comprises a first rigid, substantially flat plate. Housing or first plate 16 has a first set of a plurality of spaced holes 18 formed therethrough along a first side thereof. This first set of holes 18 are spaced and sized for engagement with rivets. The housing (or first plate) 16 includes a set of a plurality of spaced holes 20 formed on a second side of the housing 16. The housing 16 further includes an opening 22 in a central portion thereof. A plurality of spaced hinges 24 are located on a side edge of the side portion defined by the opening 22.

A second rigid plate 26 has a first side hingedly connected via the spaced hinges 24 to the first rigid plate 16. The second plate 26 has a shape complementary to, and substantially matching, the shape of the central opening 22 so that when the second rigid plate 26 is in the stowed position illustrated in FIG. 1 it may be supported within the central opening 22.

Second plate 26 includes spaced projections 28 formed on an upper surface thereof. The projections 28 are sized and spaced so as to align with the second set of spaced holes 20 in the first plate 16 when the second plate 26 is rotated away from the stowed position. Thus, a holepunching capability is provided when paper is inserted between the two plates 16, 26.

FIGS. 2A–2C illustrate such a sequence of operations. In the stowed position 30 (FIG. 2A) the second plate 26 rests against the book 12 and flush with the first plate 16. Paper 36 is placed on the backside of the second plate 26, as shown in FIG. 2B.

Referring now to FIG. 2C, as the plate 26 rotates in the direction of arrow 31 it goes through intermediate positions 32, 34 and then finally cuts holes in paper 36 at the final position.

Referring again to FIGS. 2B, it can be seen that the first and second plates 16, 26 each have substantially the same thickness, t. Furthermore, the projections 28 and hinges 24 come to substantially the same height, h, from the upper surface of the book. Therefore, when the apparatus 10 is in a stowed position the thickness of the apparatus 10 is minimized. The first plate 16 is maintained flush with the second plate 26. The height, h, of the holepunch assembly 14 is approximately between 2/32 inches and ¼ inch. The holepunch assembly 14 is preferably formed of plastic material; however, it may be formed of metal or a glass or metal filled plastic.

Other devices may be integrated into the holepunch assembly 14, such as a clock (not shown) which may preferably be attached within another opening of the housing 16. Such a clock may have multiple alarms so that it can be used as an appointment reminder. Furthermore, it may have a variety of assorted settings such as daily alarms, etc.

Tab 54 and opening 50 provide convenient opening and closing of the second plate 26.

Holepunch assembly 14 preferably also includes spaced paper positioning projections 44, 46 for assuring that the paper is maintained in the proper position for holepunching. An enlarged view of upper projection 46 is shown in FIG. 4.

Unlike with most prior art holepunch insert devices the hinges 24 of the present invention allow the second rigid plate 26 to be rotated 180 degrees thereby minimizing the overall thickness of the apparatus 10.

Referring now to FIG. 3, an enlarged view of a projection or punch 28 is shown. It preferably has a concave upper surface which provides enhanced cutting capabilities.

Referring now to FIGS. 5–7, an alternate embodiment is illustrated, designated generally as 60. In this embodiment, the housing of the holepunch assembly comprises a first rigid plate 62 and a third rigid plate 64 hingedly connected, via spaced hinges 66, to the first rigid plate 62. The third rigid plate 64 contains a plurality of holes 68 for providing holepunching. A second rigid plate 70 having spaced projections 72, as in the previous embodiment, is also hingedly connected via hinges 66 to the first and third rigid plates 62, 64.

As shown in FIG. 6, the third rigid plate 64 may be maintained in a stowed, closed position when the holepunch assembly is not being used, thereby minimizing the width of the book.

As can be seen in FIG. 7, when the third rigid plate 64 is opened, the embodiment 60 can be utilized in the same manner as the previous embodiment. In summary, the first embodiment minimizes the thickness of the book while the second embodiment minimizes the width of the book.

Obviously, many modifications and variations of the present invention are possible in light of the above teachings. It is, therefore, to be understood that within the scope of the appended claims, the invention may be practiced otherwise than as specifically described. For example, although the invention has been described in terms of a separate book unit and holepunch assembly unit, it is contemplated that the book and holepunch assembly may be formed of integral, unitary construction.

What is claimed and desired to be secured by Letters Patent of the United States is:

1. A combination book and holepunch assembly, comprising:

a book having a flat portion thereon; and a holepunch assembly securely attached to said flat portion, said holepunch assembly comprising:

(a) a housing comprising a first rigid substantially flat plate securely connected to said flat portion, said housing having a set of a plurality of spaced holes formed therethrough a side thereof;

said housing further including an opening in a central portion thereof; and a plurality of spaced hinges, said hinges being located on a side edge of said central portion defined by said opening; and (b) a second rigid plate having a first side hingedly connected via said spaced hinges to said first rigid plate, said second plate having a shape complementary to the shape of said central opening so when said second rigid plate is in a stowed position it may be supported within said central opening, said second plate including spaced projections formed on an upper surface thereof, said projections being so sized and spaced to align with said second set of spaced holes in said first plate when said second plate is rotated away from said stowed position so as to provide a holepunching capability when paper is inserted between said first plate and said second plate.

2. The combination book and holepunch assembly of claim 1, wherein said first rigid plate is securely attached to said flat portion of said book at a first end of said first rigid plate, a second side of said first rigid plate containing said plurality of spaced holes, thereby minimizing the thickness of said book.

3. The combination book and holepunch assembly of claim 1, wherein said housing further comprises a third rigid plate hingedly connected to said first rigid plate, said third rigid plate containing said plurality of spaced holes, wherein said third rigid plate may be maintained in a stowed, closed position when said holepunch assembly is not being used, thereby minimizing the width of said book.

4. The combination book and holepunch assembly of claim 3, wherein said third rigid plate is hingedly connected via said plurality of spaced hinges.

5. The combination book and holepunch assembly of claim 4, wherein said second rigid plate and said third rigid plate comprise alternatively spaced hinges for providing said hinged connections.

6. The combination book and holepunch assembly of claim 1, wherein said book comprises a ringed binder.

7. The combination book and holepunch assembly of claim 1, wherein said hinges provide 180 degree rotation of said second plate relative to said first plate thereby minimizing the total thickness of said apparatus.

8. The combination book and holepunch assembly of claim 1, wherein said flat portion and said first rigid plate are integrally connected.

9. A combination book and holepunch assembly, comprising:

a book having a flat portion thereon; and a holepunch assembly securely attached to said flat portion, said holepunch assembly comprising:

(a) a housing comprising a first rigid substantially flat plate securely connected to said flat portion, said housing having a set of a plurality of spaced holes formed therethrough; and, (b) a second rigid plate having a first side hingedly connected to said first rigid plate, said second plate including spaced projections formed on an upper surface thereof, said projections being so sized and spaced to align with said second set of spaced holes in said first plate when said second plate is rotated away from a stowed position so as to provide a holepunching capability when paper is inserted between said first plate and said second plate.

10. The combination book and holepunch assembly of claim 9, wherein said first rigid plate is securely attached to said flat portion of said book at a first end of said first rigid plate, a second side of said first rigid plate containing said plurality of spaced holes, thereby minimizing the thickness of said book.

11. The combination book and holepunch assembly of claim 9, wherein said housing further comprises a third rigid plate hingedly connected to said first rigid plate, said third rigid plate containing said plurality of spaced holes, wherein said third rigid plate may be maintained in a stowed, closed position when said holepunch assembly is not being used, thereby minimizing the width of said book.

12. The combination book and holepunch assembly of claim 11, wherein said third rigid plate is hingedly connected via a plurality of spaced hinges.

13. The combination book and holepunch assembly of claim 12, wherein said second rigid plate and said third rigid plate comprise alternatively spaced hinges for providing said hinged connections.

14. The combination book and holepunch assembly of claim 9, wherein said book comprises a ringed binder.

15. The combination book and holepunch assembly of claim 9, wherein said hinges provide 180 degree rotation of said second plate relative to said first plate thereby minimizing the total thickness of said apparatus.

16. The combination book and holepunch assembly of claim 9, wherein said flat portion and said first rigid plate are integrally connected.

* * * * *